United States Patent [19]

McNair

[11] Patent Number: 4,698,930

[45] Date of Patent: Oct. 13, 1987

[54] FILM HOLDER

[75] Inventor: Rhett McNair, Anaheim, Calif.

[73] Assignee: Scientific Component Systems, Inc., Anaheim, Calif.

[21] Appl. No.: 680,719

[22] Filed: Dec. 12, 1984

Related U.S. Application Data

[62] Division of Ser. No. 553,568, Nov. 21, 1983, abandoned.

[51] Int. Cl.[4] ..... G08B 21/02

[52] U.S. Cl. ..... 40/361; 40/10 R; 40/617

[58] Field of Search ..... 40/361, 362, 364, 617, 40/11 R, 10 R, 10, 13, 361

[56] References Cited

U.S. PATENT DOCUMENTS

| | | | |
|---|---|---|---|
| 2,530,821 | 11/1950 | Hubbell | 40/617 |
| 2,760,288 | 8/1956 | Shoenfeld | 40/361 |
| 3,256,629 | 6/1966 | Whitman | 40/617 |
| 4,527,347 | 7/1985 | Ohlson | 40/361 |

FOREIGN PATENT DOCUMENTS

| | | | |
|---|---|---|---|
| 342601 | 8/1936 | Italy | 40/617 |

*Primary Examiner*—Gene Mancene
*Assistant Examiner*—Wenceslao J. Contreras
*Attorney, Agent, or Firm*—James C. Wray

[57] ABSTRACT

Three embodiments for a holder for film, papers, canvas, sheets and the like, are disclosed. Each of the embodiments presented utilizes gravity in some fashion for the holding function. The invention generally comprises a recessed horizontal groove located upon a vertical planar surface which is covered by the holding assembly. The holding assembly comprises a vertical planar cover, the bottom edge of which participates in the holding. An object to be held is slipped between the bottom edge and the vertical planar surface and extended into the groove. Whereupon gravity means holds the object in a hanging fashion.

22 Claims, 6 Drawing Figures

FILM HOLDER

This is a division of application Ser. No. 553,568, filed Nov. 21, 1983, now abandoned.

BACKGROUND OF THE INVENTION

The invention relates to supports, racks, buckles, buttons, clasps and the like and generally any specially mounted gripping article. More in particular, the invention relates to those gripping articles being wall mounted and having trackways, pivoted supports, horizontal rods and being especially adapted to hold paper, canvas, books, music sheets, or their equivalent.

Examples of prior art devices are found in the United States Patent and Trademark Office, particularly as classified in Class 211, Supports, Racks, subclasses 45, 89, 124; Class 24, Buckles, Buttons, Clasps, etc., subclasses 67.3, 67.11, 67.9; Class 248, Supports, subclass 452; Class 362, Illumination, subclass 375, 396. Examples of patents from these subclasses are: U.S. Pat. Nos. 2,518,563, 3,364,528, 4,194,635 and 4,404,619.

These patents all show various holding assemblies adapted to be mounted on a vertical surface.

U.S. Pat. No. 2,518,563 discloses a spring clip device. The gripping pressure is adjustable on this invention; however, it is believed that this adjustability is bulky, complicated, and unnecessary.

U.S. Pat. No. 3,364,528 discloses a gripping clamp. This clamp has a channel section as well as a pressure applying member. This pressure applying member is movable inwardly and outwardly by means of adjusting a wing nut. It is believed this structure is not only complicated but would take more time than is necessary to set something within this gripping apparatus.

U.S. Pat. No. 4,194,635 teaches the use of a spring biased x-ray film grip. The pressure applying member in this case is spring biased.

U.S. Pat. No. 4,404,619 teaches the use of a gripping assembly utilizing a ball weight.

Problems exist in the prior art in that known gripping devices mounted on vertical surfaces, so-called clips, are either complicated in that they have more parts than is necessary to effect efficient gripping or are unwieldy requiring the use of more than one hand or gripping pressure adjustments prior to the gripping function. These problems are solved by the present invention in that the invention provides a gripping assembly with a minimum of working parts which works primarily with gravity to effect the gripping function.

SUMMARY OF THE INVENTION

The invention provides three embodiments of a holdfast. Each utilizes gravitational force in conjunction with the gripping assembly to hold objects. The devices are adapted to be used on a vertical surface to hold objects in a hanging-like fashion.

The first embodiment includes a recessed, horizontally extending groove having a curved back wall located on a flat vertical surface. A cover for the groove is provided which is attached to the flat vertical surface just above the groove. The bottom edge of the cover is not attached but provides a space into which an object to be held may be slipped, allowing the object to extend into the groove. A ball is provided in the groove which weights down the object to be held. The cover is flat so the holdfast does not protrude from the vertical surface to any significant extent.

A second embodiment is shown which also has a recessed, horizontally extending groove located on a flat vertical surface. This groove has a flat back wall parallel to the flat vertical surface and top and bottom walls which are perpendicular to the flat back wall. The front wall is the back side of the groove cover. On the bottom wall of the groove is located an upwardly projecting ridge with sloping sides. This is deemed the mounting means. Extending from the back side of the groove cover into the groove is a mantel or shelf, the leading edge of which is bent downwardly. This mantel rests on the top of the ridge with the bent edge resting on the backmost sloping side of the ridge. This bend acts like a hook maintaining the flat cover upon the flat vertical surface in a somewhat flush alignment. Because the cover is of a weighty material, the bottom edge rests on the flat vertical surface. In order to have the device grip an object, the bottom edge of the cover is urged in an upward fashion, the object slipped into the space provided, and the cover is allowed to return to its resting place. The weight of the cover holds the object in place. When the cover is moved in an upward fashion the bent edge of the mantel rocks or pivots upon the ridge located in the groove. This is deemed the pivot means. The bottom edge may be urged in an upward fashion, either by lifting the bottom edge with one's hand or by pushing the object to be held between the flat vertical surface and the bottom edge of the groove cover. This bottom edge of the groove cover is sloped in a forward downward direction such that an apron for receiving is provided. When one places an object to be held within this receiving area, the sloping bottom edge guides the object such that the cover is forced in an upward fashion and the object is then held by the weight of the cover.

The third embodiment is similar to the second embodiment in that the groove has a flat back wall and top and bottom walls which are perpendicular to the back wall. However, the mounting means within the groove comprise a pintle or a horizontal rod. The mantle protruding from the back side of the groove cover is provided with a horizontal bore extending therethrough and adapted to receive and pivot upon the horizontal rod mounted within the groove. Again, the object to be held is pinched in between the bottom edge of the groove cover and the flat vertical surface. The weight of the cover and holding assembly holds the object in place upon the flat vertical surface.

This third embodiment is particularly amenable for a serial alignment of these holdfasts. This serial embodiment may comprise a common groove having mounting means, and a plurality of covers having pivot means arranged in serial alignment over the common groove. Each cover with pivot means may be discretely separated from neighboring covers with mantel pieces by septums which among other things may be used to mount a pintle or pivot rod.

These embodiments of the invention may be a one-piece, short or long assembly or may be several or many such devices in serial alignment with each device discretely separated by borders such that each assembly is provided with its own groove.

In is an object of this invention to provide a relatively nonprotruding holdfast.

It is also an object of this invention to provide a relatively simple assembly.

It is another object of this invention to provide a holdfast for vertical surfaces which utilizes the force of gravity to hold an object secure.

It is yet another object of this invention to provide a hold fast which is devoid of springs, adjustment screws, and assemblies which protrude extensively from the vertical surface upon which they are attached.

DETAILED DESCRIPTION OF THE INVENTION

Figure 1:
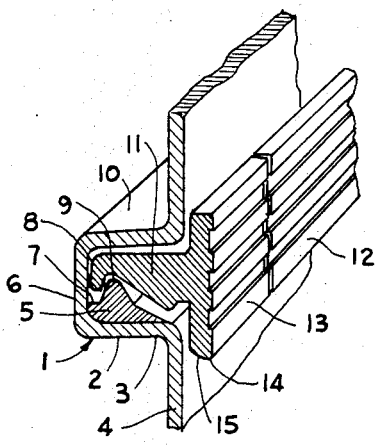
FIG. 1 is a side elevational view of an embodiment of the invention.

The invention contemplates being mounted on a surface which is substantially vertical all of the time in order that gravitational forces may be utilized in the gripping function. Referring now to FIG. 1, the invention is mounted on a vertical surface 4. A horizontally extending recessed groove 1 is provided on vertical surface 4. This groove has a back wall 6, a top wall 10 and a bottom wall 2. Located upon the bottom wall 2 is ridge 5 which extends in an upward fashion 9 having sloping sides. A cover 13 for groove 1 is provided. Extending into the groove from the back face of cover 13 is mantel 11. The leading edge 8 is bent in a downward direction and fits over top of the ridge top 9 and rests upon the back side of ridge 9 at point 7. As can be seen, the cover which is of a weighty material, rests upon the vertical surface 4 along its bottom edge 14. There is a little room between the top edge of the cover 13 and the vertical surface 4, allowing for area to pivot. For an object to be held by the embodiment of FIG. 1, cover 13 is urged in an upward fasion and the object is slipped between the bottom edge and the vertical surface, whereupon the cover 13 is allowed to come back to its resting point thereby holding the object fast. If the object to be held is substantially rigid it alone may urge cover 13 in an upward fashion such that the cover may come back to rest upon the object wedged between the bottom edge and the surface 4. The bottom edge of cover 13 is sloped in a downward forward direction 15. This provides an apron receiving area for objects to be held.

Figure 3:
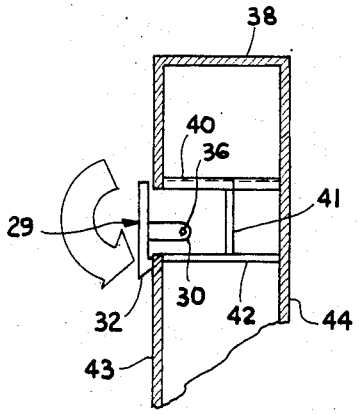
FIG. 3 is a diagrammatic side view of still another alternate embodiment of the invention.
Figure 6:
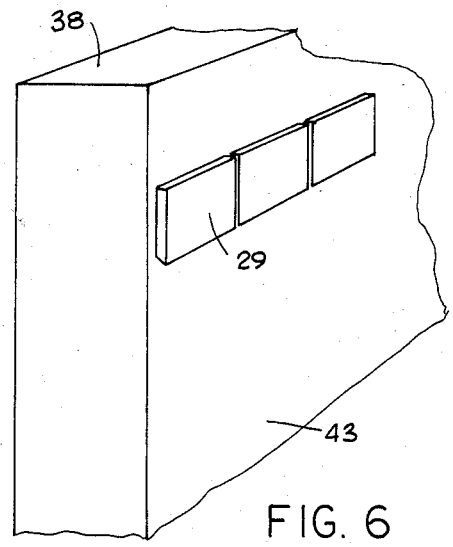
FIG. 6 shows a corner of the device.
Figure 4:
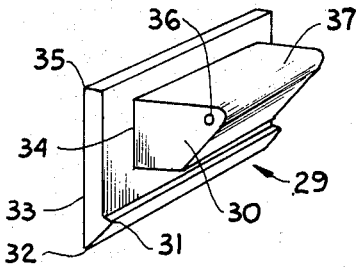
FIG. 4 is a back side elevational view of gripping apparatus shown in FIG. 3.

Referring now to FIGS. 3, 4 and 6, a modification of FIG. 1 can be best understood. Here there is a vertical surface 43 upon which is located a recessed groove having walls 40, 41 and 42. Located within the groove is a horizontally extending pin or pintle which is the mounting means used to effect a pivoting of the front cover 29. The mantel 30 extending in the groove from the back side of cover 29 is provided with a horizontal bore 36 extending therethrough and adapted to receive the pintle. As in the embodiment disclosed in FIG. 1, the front cover 29 rests upon surface 43 at the bottom edge 32. A sufficient enough room is left between the top edge of front cover 29 and the vertical surface such that cover 29 and mantel 30 may pivot upon the pintle in the groove creating a space between bottom edge 32 and surface 43 such that an object to be held may be introduced. Bottom edge 32 is also sloped downwardly and forwardly providing an apron for receiving an object to be held.

Referring to FIG. 4, the inside edge 31 of bottom edge 32 may form a spur or protruding lip whereby the object to be held may be more securely gripped.

Figure 2:
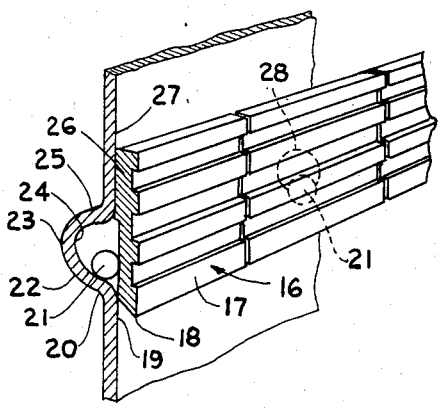
FIG. 2 is a side elevational view of an alternate embodiment of the invention.

FIG. 2 disclosed yet another embodiment of the invention which is more readily appreciated on vertical surfaces not having the depth available for a groove as in FIG. 1 or FIG. 3. Here, a rounded groove 20 is formed on surface 19. As can be seen, the inside of the groove 24 is curved such that a ball 21 when placed in groove 24 rests naturally at a point in the groove between the bottom of the groove 20 and the back side of the front cover 16. The groove has a top curving wall 25 which extends rearward before curving precipitously at the back of the groove 23. The bottom of the groove 22 slopes downward and forward providing a track for ball 21 which allows the ball to be in close proximity to the bottom edge of the front cover 16. Number 28 shows the arrangement of the groove behind cover 16 with the ball 21 therebetween. The object to be held is slipped into the space between points 19 and 18 whereupon ball 21 will weight down the top of the object to be held holding the object fast along vertical surface 19.

Figure 5:
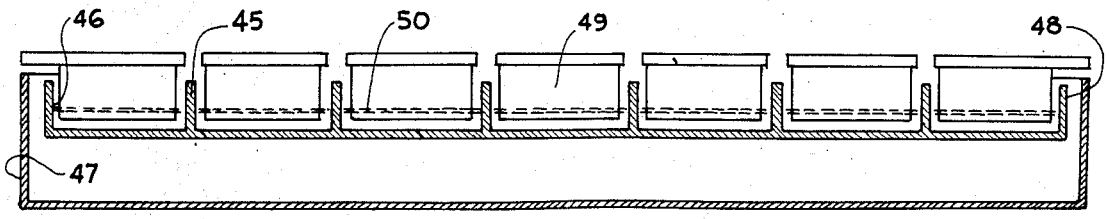
FIG. 5 is a front diagrammatic view of the invention in serial alignment.

FIG. 5 shows an arrangement of embodiments of the invention in serial alignment. It is conceivable that a structure is necessary for gripping many things along a vertical surface at the same time. Such things may be x-ray films, blueprints, photographs, etc. A framework 47 is contemplated wherein discreate borders 46, 45, and 48 separate each individual holdfast 49.

A common groove having mounting means may be formed on a vertical surface whereupon covers with pivot means may be mounted serially as shown in FIG. 5. It also should be noted that separate compartmentalized grooves may be used for each cover with pivot means. FIG. 5 shows a mounting means 50 being a pintle or pivot rod which may be one long rod mounted in a common groove upon which a plurality of covers with pivot means may be mounted.

Any number of ways can be devised to construct the invention. An important consideration in assembling the invention is to be sure that the pivot means, being the front cover and mantel, are of a sufficient weight to hold an object such as a film or a sheet of paper between the bottom edge of the front cover and flat vertical surface upon which the invention is mounted. The starting point in assembling the invention is the shaping of the groove. How this groove is to be formed depends upon the type of material comprising the flat vertical surface upon which the recessed groove is to be placed. If the surface is plastic obviously molding the plastic into the desired shape would be the best mode. However, if the surface is metal it may still be molded or bent, as with sheet metal, and if the surface is wood or anything else, the groove may be made in piecemeal fashion. That is, the groove may be manufactured separately by affixing top and bottom and back walls together and recessing this structure into the surface upon which the holdfast will be mounted. Probably the easiest and least intrusive embodiment is that of FIG. 2. A groove may be recessed into surface 19 and a flattened cover may be affixed over this groove by attaching the edge of the cover to the surface above the groove, making sure to leave a slight space at the bottom edge between the bottom edge and the surface just below the groove. This allows for the object to be held to be slipped up into the groove where it will be held fast by the gravitational force exerted by the weighted ball. It should be said from the outset that preferably a steel ball bearing or similar high density material should be used to weight the object down.

If the embodiments of FIG. 1 and FIG. 3 are chosen, then the groove should be primarily rectangular in cross section. The bottom wall of the groove, for the FIG. 1 embodiment, has an upwardly projecting ridge formed thereon. This ridge may be attached by any suitable means or molded integrally with the groove. This ridge may be constructed of a lightweight material or any material. The front cover and mantel must be sufficiently heavy so as to provide an adequate weight for holding objects placed between the bottom edge and the front surface. It is preferred that some alloy of metal or some other heavy. rigid material be used to form this structure. The front cover must be essentially flat but may have design ridges as shown which may perform several different functions, or can be completely flat and congruent with the front planar surface upon which the device is mounted. It is preferred that this front cover not be too thick so as to protrude to any significant extent beyond the surface upon which the device is mounted. The mantel protruding from the back side of the groove cover may be affixed or molded integrally thereon. The bend on the leading edge of the mantel may be molded or the material of which the mantel is formed may be deformed to form this bend. The cover and mantel may be inserted into the groove such that the bent leading edge of the mantel slips over the top of the ridge and rests on the back side.

The alternate embodiment of the pivot means shown in FIG. 1, which is disclosed in FIGS. 3 and 4, may be similarly constructed. However, instead of the ridge being formed on the bottom wall, a pintle or horizontal rod is fixed in the groove. This pintle may be mounted in the end walls of the groove, as shown in FIG. 5, numbers 46 and 45. The pintle may be permanently mounted in this fashion or it may be a spring biased telescoping pintle much akin to the type of pin holding a watch band on a watch. As in the embodiment of FIG. 1, the mantel of FIG. 3 may be affixed or molded integrally on front cover 29 and a through bore 36 may be drilled or machined in any fashion through the mantel. The pintel may be placed within the bore and then the pintle mounted within the groove.

While specific embodiments of the invention have been described in their best mode, it is to be understood that the invention contemplates any device designed as a hold fast to be mounted on a vertical surface, having a recessed groove on said vertical surface and a cover for said groove substantially flush with said surface and gravitational forces being utilized to effect the pressure for holding an object fast to the vertical surface. Having set out the best modes of my invention, I now set out the spirit and scope of my invention by the following claims.

What I claim is:

1. A film holder, comprising:

(a) a first vertical planar member having a front face;

(b) a recessed horizontally extending groove located upon said front face;

(c) mounting means located within said groove;

(d) a holding member having a second vertical planar member with front and rear faces, top and bottom edges, said second member adapted to cover and overlap said groove, said rear face provided with rearward extending pivoting means mounted on said mounting means, said second vertical member being maintained in relation to said first member by virtue of said pivoting means and mounting means and said bottom edge of said second planar member resting on said front face, whereby an object is held by urging said bottom edge of said second planar member in an upward fashion causing said pivoting means to pivot, thereby creating a space whereupon an object to be held may be positioned in said space and said bottom edge of said second planar member is allowed to return and rest upon said front face by gravitational forces, thereby removably holding said object.

2. The device of claim 1 where said groove further comprises a vertical back wall parallel to said front face, top and bottom walls perpendicular to said back wall.

3. The device of claim 2 where said mounting means further comprises an upwardly projecting ridge having front and back sloping sides provided on said bottom wall. .

4. The device of claim 3 where said pivoting means further comprises a rearward extending mantel projecting from said rear face having a downward bent leading edge, said mantel extending into said groove and resting on said ridge with said bent edge resting on said back sloping side, said second vertical member being maintained in relation to said first member by virtue of said mantel hooking over said ridge and said bottom edge of said second planar member resting on said front face, whereby an object is held by urging said bottom edge of said second planar member in an upward fashion causing said mantel to pivot on said ridge thereby creating a space, whereupon an object to be held may be positioned in said space and said bottom edge of said second planar member is allowed to return and rest upon said front face by gravitational forces thereby removably holding said object.

5. The device of claim 1 where said pivoting means further comprises a rearward projecting mantel having a hole adapted to receive said rod, whereby said mantel is able to revolve about said rod.

6. The device of claim 5 wherein said bottom edge is sloped in a forward downward direction, whereby an apron is provided for receiving objects to be held.

7. The device of claim 4 situated in serial arrangement with other such devices.

8. The device of claim 7 wherein each device in serial arrangement is a discrete unit in and of itself separated from said other devices with a discrete border.

9. The device of claim 4 wherein each device in serial arrangement is a discrete unit in and of itself separated from said other devices with a discrete border.

10. The device of claim 7 wherein each device in serial arrangement is a discrete unit in and of itself separated from said other devices with a discrete border.

11. The device of claim 6 where said bottom edge further comprises a rearward extending spur from which point said bottom edge slopes downward and forward to a front point, wherein said spur rests upon and is adjacent to said front face of said first vertical planar member.

12. The device of claim 4 where said bottom edge further comprises a rearward extending spur from which point said bottom edge slopes downward and forward to a front point, wherein said spur rests upon and is adjacent to said front face of said first vertical planar member.

13. The device of claim 6 where said bottom edge further comprises a rearward extending spur from which point said bottom edge slopes downward and forward to a front point, wherein said spur rests upon and is adjacent to said front face of said first vertical planar member.

14. A film holder comprising:

(a) a first vertical planar member having a front face;

(b) a recessed horizontally extending groove located upon said front face;

(c) mounting means located within said groove, said mounting means further comprising a horizontally extending rod;

(d) a holding member having a second vertical planar member with front and rear faces, top and bottom edges, said second member adapted to cover and overlap said groove, said rear face provided with pivoting means, said pivoting means further comprising a rearward projecting mantel having a hole adapted to receive said rod, whereby said mantel is able to pivot about said rod, said second vertical member being maintained in relation to said first member by virtue of said pivoting means, mounting means and said bottom edge of said second planar member resting on said front face, whereby an object is held by urging said bottom edge of said second planar member in an upward fashion causing said pivoting means to pivot, thereby creating a space whereupon an object to be held may be positioned in said space and said bottom edge of said planar member is allowed to return and rest upon said front face by gravitational forces, thereby removably holding said object.

15. A plurality of film holders, comprising:

(a) a first vertical planar member having a front face;

(b) a recessed horizontally extending groove located upon said front face;

(c) mounting means located within said groove;

(d) a plurality of holding members arranged in serial alignment with each having a vertical planar member with front and rear faces, top and bottom edges, said vertical members being adapted to cover and overlap said groove, said rear faces being provided with rearward extending pivoting means mounted on said mounting means, said vertical members being maintained in relation to said first vertical planar member by virtue of said pivoting means, mounting means and said bottom edges of said vertical members resting on said front face of said first vertical planar member, whereby objects are held by urging said bottom edges of said vertical members in an upward fashion causing said pivoting means to pivot, thereby creating a space whereupon objects to be held may be positioned in said spaces and said bottom edges of said vertical members are allowed to return and rest upon said front face of said first vertical planar member by gravitational forces, thereby removably holding said objects, wherein said mounting means further comprises a rod.

16. The device of claim 15 where said groove further comprises a vertical back wall parallel to said front face, top and bottom walls perpendicular to said back wall.

17. The device of claim 16 where said mounting means further comprises an upwardly projecting ridge having front and back sloping sides.

18. The device of claim 17 where said pivoting means further comprises a rearward extending mantel projecting from said rear face having a downward bent leading edge, said mantel extending into said groove and resting on said ridge with said bent edge resting on said back sloping side, said second vertical member being maintained in relation to said first member by virtue of said mantel hooking over said ridge and said bottom edge of said second planar member resting on said front face, whereby an object is held by urging said bottom edge of said second planar member in an upward fashion causing said mantel to pivot on said ridge thereby creating a space, whereupon an object to be held may be positioned in said space and said bottom edge of said second planar member is allowed to and rest upon said front face by gravitational forces thereby removably holding said object.

19. The device of claim 15 where said pivoting means further comprises a rearward projecting mantel having a hold adapted to receive said rod, whereby said mantel is able to revolve about said rod.

20. The device of claim 19 wherein said bottom edge is sloped in a forward downward direction, whereby an apron is provided for receiving objects to be held.

21. A film holder comprising a vertical surface upon which the film is held for viewing, the vertical surface having a recessed horizontally extending groove formed in an upper portion of the vertical surface, a cover overlying the groove and having a vertically oriented portion and a horizontally oriented portion, the horizontally oriented portion extending into the groove, means, disposed within the groove, for pivotally connecting the cover to the groove, wherein weight of the cover forces a lower edge of the cover into contact with the vertical surface, whereby a film is pushed between the lower edge of the cover and the vertical surface and held in place by the weight of the cover.

22. The apparatus of claim 1 wherein said mounting means further comprises a rod.

* * * * *